United States Patent [19]

Haynes

[11] 4,403,654

[45] Sep. 13, 1983

[54] TORQUE TRANSMITTING EXPANSION JOINT AND A HANGER ASSEMBLY INCORPORATING SAME

[75] Inventor: Andrew Haynes, Missouri City, Tex.

[73] Assignee: Baker International Corporation, Orange, Calif.

[21] Appl. No.: 246,767

[22] Filed: Mar. 23, 1981

[51] Int. Cl.[3] ..... E21B 17/07

[52] U.S. Cl. ..... 166/73; 166/240; 166/313; 285/302

[58] Field of Search ..... 166/73, 240, 242, 189, 166/313; 175/322; 285/302, 24, DIG. 23; 464/162, 167

[56] References Cited

U.S. PATENT DOCUMENTS

| | | | |
|---|---|---|---|
| 3,036,641 | 5/1962 | Nutter et al. | 166/240 |
| 3,703,104 | 11/1972 | Tamplen | 166/240 |
| 4,050,512 | 9/1977 | Giebeler | 166/240 |
| 4,051,894 | 10/1977 | Goad | 166/73 |
| 4,143,712 | 3/1979 | James et al. | 166/313 |
| 4,280,341 | 7/1981 | Krude | 464/167 |
| 4,281,858 | 8/1981 | Bowyer | 285/302 |

*Primary Examiner*—Ernest R. Purser

*Assistant Examiner*—William P. Neuder

*Attorney, Agent, or Firm*—W. C. Norvell, Jr.

[57] ABSTRACT

A hanger assembly for use in a subterranean well incorporates a torque transmitting expansion joint providing a selectively adjustable extent of axial contraction. The expansion joint essentially comprises a telescopic interrelationship of two sleeve assemblies. One sleeve assembly carries a fixedly mounted rectangular key which is engagable only with an axially extending slot provided in the other sleeve assembly. The first mentioned sleeve assembly also rotatably mounts a key which cooperates with a peripherally extending slot provided in the other sleeve assembly. The axial extending slot connects with a trough portion of the peripherally extending slot. Successive reciprocations of the two sleeve assemblies produce an incremental rotation of the round key around the peripherally extending slot and normally limits the extent of axial contraction of the two sleeve assemblies to the axial extent of such peripherally extending slot. When the key reaches an angular position in which it is aligned with the axially extending slot, an increased amount of contraction of the two sleeve assemblies can be obtained.

13 Claims, 8 Drawing Figures

TORQUE TRANSMITTING EXPANSION JOINT AND A HANGER ASSEMBLY INCORPORATING SAME

BACKGROUND OF THE INVENTION

1. Field of the Invention

The invention relates to a torque transmitting expansion joint providing a selectively adjustable extent of axial contraction and to a conduit hanger assembly incorporating same.

2. Description of the Prior Art

It has become the practice in completing many subterranean wells to incorporate a tubing hanger assembly at a relatively elevated downhole position within the well casing and to suspend the production tubing extending to the production zones from such tubing hanger. Intermediate the tubing hanger and the top of the well there is commonly provided one or more production tubing strings commonly referred to as a "space-out section" which extends to a well surface hanger which is utilized to suspend the tubing string weight intermediate the downhole hanger and the surface hanger. It is customary and desirable to incorporate in such space-out section, a sub-surface safety valve, there being a valve incorporated in each of the production strings.

As is well known, it may be desirable to periodically remove the safety valves for servicing, and this may be conveniently accomplished by releasing the surface hanger and pulling the tubing strings of the space-out section which are releasably sealingly latched in the downhole tubing hanger. This eliminates the necessity of retrieving the entire string of production tubing, the majority of which is located below the downhole tubing hanger.

The re-insertion of the pulled tubing does, however, present some difficulties, particularly in the insertion of the seal mandrel, commonly carried by the bottom end of the pulled tubing string, into the cooperating annular seals carried within the downhole tubing hanger. This operation, commonly called "spudding," often requires the application of substantial axial force.

The surface hanger normally seats in a bowl secured to the top of the casing. Thus, there is a fixed distance between the location of the downhole or sub-surface tubing hanger and the location of the surface hanger, and it becomes essential to incorporate in each of the tubing strings constituting the space-out section, a telescoping joint which is capable of performing three functions. First, the joint must be capable of expansion or contraction to absorb temperature produced variations in length of the space-out section or dimensional differences between the planned and actual location of the surface hanger with respect to the downhole hanger. Secondly, the telescoping joint must have rotational or torque transmitting capability so that rotation can be accomplished through the joint to the right or to the left in order to perform required operations on various pieces of apparatus carried by the tubing string. Thirdly, the telescoping joint must have the capability of performing the "spudding" operation without absorbing all of the contraction capability of the particular telescoping joint in order to get the mandrel fully engaged with the seals of the sub-surface hanger, and still provide for proper engagement of the space-out tubing strings with the surface hanger which is fixed in the casing bowl.

Heretofore, a number of telescoping joints have been proposed which have provided the axial expansion or contraction feature, together with the torque transmitting ability, but the prior art has been devoid of a telescoping joint having the further characteristic of permitting the selective limitation of the maximum contraction of the expansible joint in order to effect the "spudding" operation, while retaining the ability of the expansion joint to be selectively further contracted so that the upper portion of the space-out tubing string is properly positioned relative to the cooperating hanger bowl.

SUMMARY OF THE INVENTION

This invention provides a space-out tubular production string for incorporation in a subterranean well between a surface hanger, located in a hanger bowl provided on the top portion of the well casing, and a downhole hanger which is anchored to the casing at a downhole position, but substantially above the production zone of the well. The downhole hanger provides support for the many thousands of feet of production tubing which extend to the production zone or zones of the well. The space-out section extends merely from the downhole hanger to the surface hanger, and is generally utilized to typically incorporate a safety valve, a shear out safety joint and a torque transmitting, telescoping joint constructed in accordance with this invention. The space-out section may include one or more tubing strings.

The lower end of the space-out tubing string is detachably and sealably connected to the downhole hanger and, through the hanger, to the production tubing which extends to the production zone of the well. Thus, the safety valve may be removed from the well by pulling of the space-out tubing string section from engagement with the downhole hanger, without necessitating the pulling of the entire length of production tubing. The telescoping joint incorporated in such space-out tubing string section has the capability of expansion or contraction to accommodate temperature effects and dimensional variations in the location of the downhole hanger with respect to the surface hanger. It also has the capability of transmitting torque in any position to permit the operation of apparatus carried by the space-out tubing string, or disconnection of the string from the downhole hanger. Most importantly, the telescoping joint incorporates a selective adjustment of the extent of axial contraction of the joint to permit a relatively small axial contraction of the joint when the bottom end of the tubing is re-inserted in the downhole hanger by the so-called "spudding" operation, which requires that a significant axial force be exerted on the space-out tubing string to force the seal mandrel end of the tubing string or strings into sealing engagement with the annular seals carried by the downhole hanger. Such limitation of the contracting movement of the telescoping joint may, however, be removed by a reciprocating movement of the joint elements, which permits the joint to fully contract after the "spudding" operation is accomplished. This capability permits the proper seating on the top end of the space-out tubing string or strings with the surface hanger mounted in the hanger bowl conventionally provided on the upper portion of the well casing.

A telescoping joint incorporating this invention utilizes two telescopingly related sleeve assemblies. One of such sleeve assemblies carries a key which slidably cooperates with an elongated, axially extending slot provided in the other sleeve assembly. This key and slot arrangement permits the maximum contraction of the telescoping joint and also provides for transmission of torque between the two sleeve assemblies. A second key of circular cross section is mounted on a ring which in turn is rotatably mounted on the one sleeve assembly. This second key cooperates with a peripherally extending slot provided in the other sleeve assembly so that successive elongation and contraction movements of the two sleeve assemblies relative to each other produce a movement of the circular key around the periphery of the slot. The upper end of the axial slot communicates with one of the trough portions of the slot. Thus, the extent of contraction movement of the two sleeve assemblies is normally limited by the axial extent of the peripherally extending slot, except when the round key is aligned with the axial slot and enters such slot, thereby permitting the maximum degree of contracting movement of the two sleeve assemblies to occur. A subsequent expansion movement of the two sleeve assemblies will effect the rotation of the key into the adjacent trough portion of the slot configuration, thus restoring the limited contraction movement of the two sleeve assemblies.

DESCRIPTION OF THE PREFERRED EMBODIMENTS

Figure 1:
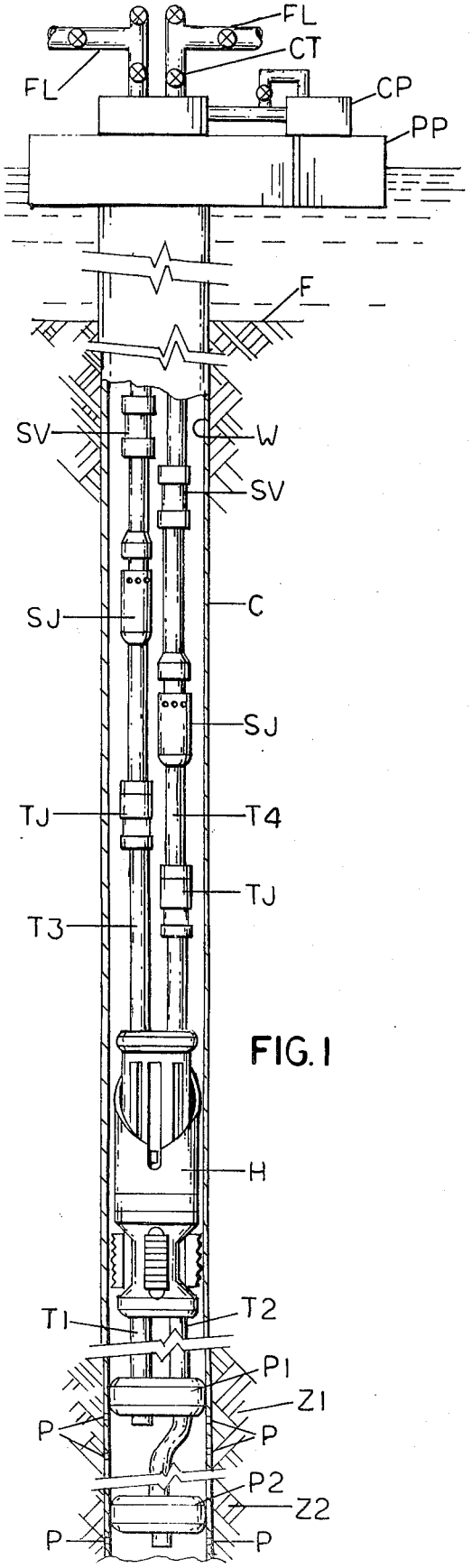
FIG. 1 is a schematic, vertical sectional view of a subterranean well incorporating a hanger assembly and space-out section embodying this invention.

Referring now to FIG. 1, a well bore W extends downwardly into the earth below the ocean floor F through vertically spaced well fluid producing zones Z1 and Z2. A casing C is set in the well bore and perforations P in the casing establish communication between the production zones Z1 and Z2 and the bore of casing C. Set in the casing C is an upper packer P1 located above the production zone Z1 and a lower packer P2 located in the casing between the production zones Z1 and Z2. A first production tubing string T1 extends from a sub-surface tubing hanger H through the packer P1 and opens into the casing therebelow to communicate with the production zone Z1. A second production tubing string T2 extends downwardly from the tubing hanger H through the upper packer P1 and downwardly through the lower packer P2 into the casing therebelow for communication with the production zone Z2. The tubing strings T1 and T2 may extend a number of thousands of feet downwardly in the casing C to the packers P1 and P2, and the weight of the tubing strings T1 and T2 are supported by the tubing hanger assembly H which is set or anchored in the well casing C.

The downhole hanger assembly H is preferably located below the ocean floor F or the mud line of a body of water, or at a desired or required depth of about five hundred to one thousand feet, more or less.

Figure 2:
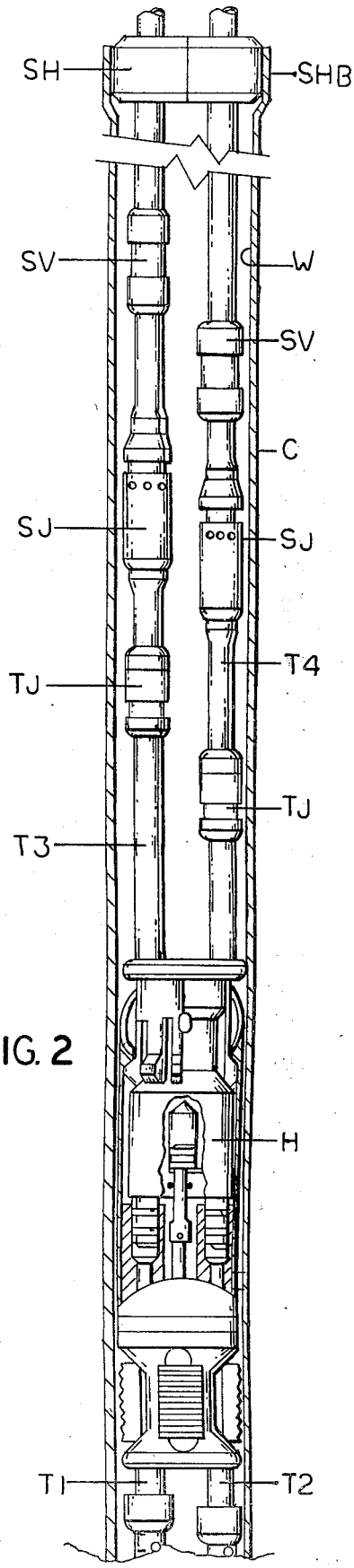
FIG. 2 is an enlarged scale, sectional view of the upper portion of the well of FIG. 1, particularly illustrating the space-out tubing string section.

The casing C extends upwardly to a production platform or barge PP. Upper production fluid tubing strings T3 and T4 extend upwardly from the hanger assembly H through a surface hanger SH (FIG. 2) and are respectively connected with Christmas trees CT on the platform PP whereby the flow of well fluid from the well zones Z1 and Z2 may be controlled or manually shut off. Flow lines FL are provided to conduct well fluids from the Christmas trees CT to suitable reservoirs or tanks (not shown).

It is very desirable to locate sub-surface safety valves SV in each production string and such valves may be respectively conveniently located in the upper production fluid tubing strings T3 and T4. The respective sub-surface safety valves SV, which are normally closed, are adapted to be held open, to enable the flow of production fluids therethrough, by means of control fluid pressure supplied through a control fluid conduit (not shown) from a source of control fluid pressure at a control panel CP on the platform PP. So long as the control fluid pressure is adequate to maintain the sub-surface valves SV open, well fluids may flow from the zones Z1 and Z2 to the respective flow lines FL. But, if it is desired for any reason to close either of the subsurface safety valves SV, or in the event of damage of the control fluid tubing, the control fluid pressure may be varied so that the sub-surface valves SV are automatically closed, thereby shutting the well in at a location below the earth surface or the ocean floor to prevent continued production fluid flow.

The sub-surface safety valves SV periodically require repair or service. With the described arrangement, only the comparatively short upper production tubing strings T3 and T4 need be pulled from the well to remove the safety valves SV, and the substantially longer production tubing string T1 and T2 remain in the well. Thus, the platform PP need not be equiped with high powered hoisting apparatus. In addition, the tubing strings T1 and T2 may be plugged off at or below the downhole hanger H with bypass plugs and sealing nipples to enable the service or repair of the safety valve SV without requiring that the well be killed.

As previously mentioned, the tubing strings T3 and T4 are sealingly engaged within the surface hanger SH which is of conventional configuration and constructed to be landed within the casing C in a profile or surface hanger bowl SHB subsequent to anchoring engagement of the downhole hanger assembly H to the casing C. The surface hanger SH is thus utilized to suspend the weight of the tubing string or strings extending from the surface hanger SH to the sub-surface tubing hanger H when the surface hanger SH is properly positioned within the surface hanger bowl SHB.

The tubing strings T3 and T4 are conventionally referred to as space-out tubing sections. In addition to the sub-surface safety valve SV incorporated in such space-out tubing strings, it is desirable to incorporate a shearout safety joint SJ in each tubing string T3 and T4. Lastly, each tubing string should preferably incorporate a telescoping joint TJ which is capable of expansion or contractual movements to assure the proper seating of the tubing strings in the surface hanger SH in the surface hanger bowl SHB and also to absorb variations in tubing length caused by fluctuations in temperature. Of equal importance, each telescoping joint TJ must be capable of transmitting torque imposed on its respective tubing string to operate apparatus carried by the tubing string or to effect the release of tubing strings T3 and T4 from the sub-surface hanger H.

The lower end of the tubing strings T3 and T4 are conventionally releasably sealingly connected in the sub-surface hanger H and to the respective production tubing strings T1 and T2. The details of such connections are completely disclosed in the co-pending application Ser. No. 036,964, filed May 7, 1979, and entitled "Single Trip Tubing Hanger Assembly," and assigned to the assignee of this application. As is well known, the bottom ends of the space-out tubing strings T3 and T4 are provided with sealing mandrel sections (not shown) which sealingly engage annular seals carried in the sub-surface hanger H. To insert such mandrels in the seals, a substantial axial force must be simultaneously exerted on the space-out tubing strings T3 and T4. During this operation, commonly referred to as "spudding," it is desirable that the maximum contraction of the telescoping joints TJ be selectively limited so that the application of the downward force to the tubing strings T3 and T4 will not cause the telescoping joints TJ to be contracted to their maximum permissible extent. In such contracted position, the upper portion of the tubing strings T3 and T4, which normally sealingly engage the surface hanger SH, may abut portions of such surface hanger before the mandrel ends of the tubing strings T3 and T4 are respectively fully seated in the seals carried by the sub-surface hanger H.

Figure 3A:
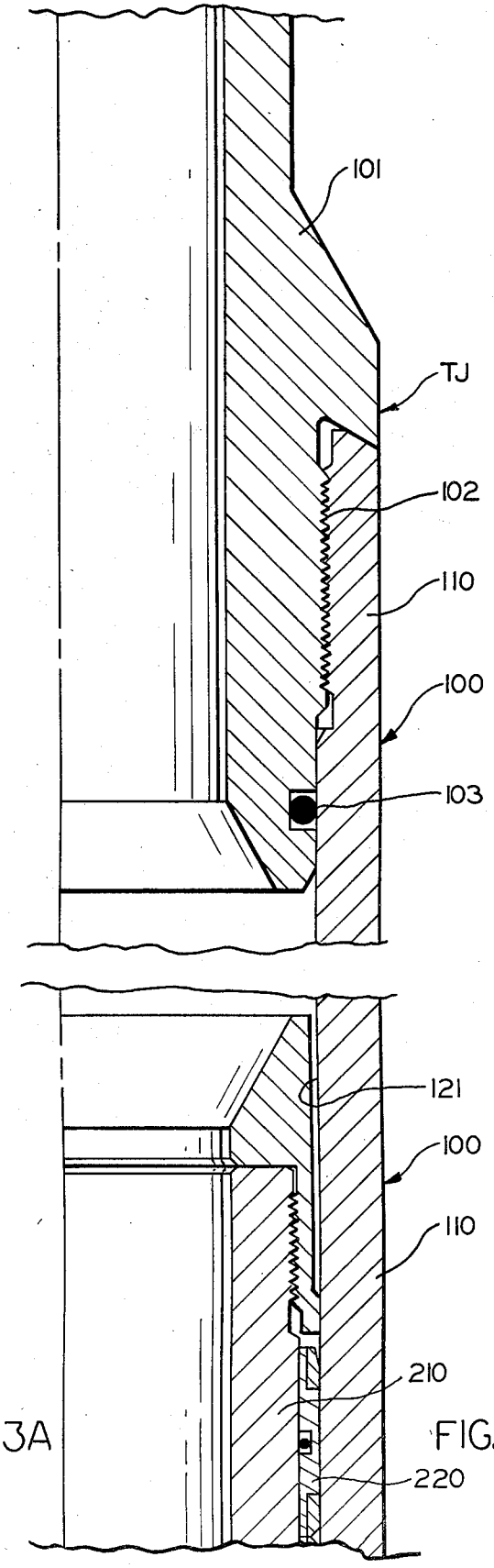
FIGS. 3A, 3B, and 3C together consitute an enlarged scale vertical sectional view of a torque transmitting expansion joint incorporated in the space-out tubing string of FIGS. 1 and 2, FIG. 3B being a vertical continuation of FIG. 3A, and FIG. 3C being a vertical continuation of FIG. 3B.
Figure 3B:
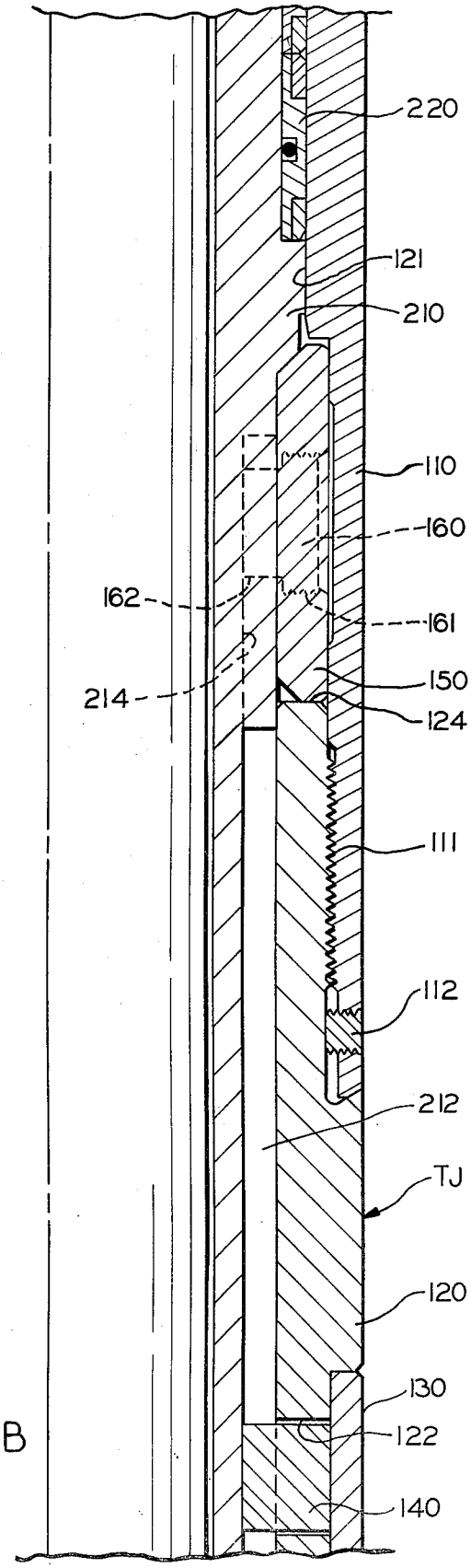
Figure 3C:
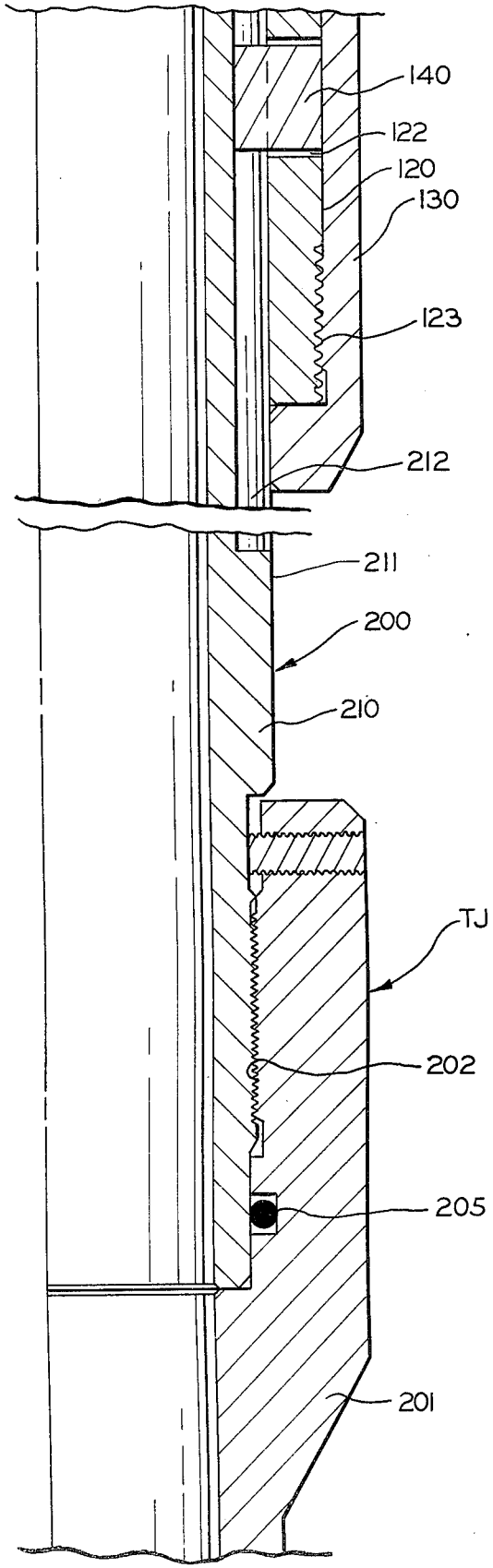

Referring now to FIGS. 3A, 3B, and 3C, there is disclosed in detail a telescoping joint TJ constructed in accordance with this invention which will permit the selective limitation of the maximum contraction of the telescoping joint TJ in order to effect the "spudding" operation without creating an interference at the upper ends of the space-out tubing strings T3 and T4 with the surface hanger SH.

The telescoping joint TJ essentially comprises two telescopically related sleeve assemblies 100 and 200. Sleeve assembly 100 has a top sub 101 which is provided with suitable threads (not shown) for incorporation in the space-out tubing string T3 or T4, as the case may be. The lower portion of sub 101 is provided with external threads 102 which engage internal threads provided in the top end of an outer sleeve member 110. A conventional O-ring seal 103 prevents fluid leakage through the threaded connection 102.

The lower end of outer sleeve 110 is threadably connected by threads 111 to a key mounting sleeve 120. A set screw 112 secures such threaded joint. The bottom end of the key carrier sleeve 120 is provided with external threads 123 to which is secured an internally threaded key retainer sleeve 130. Immediately above the threads 123, the key carrier sleeve 120 is provided with one or more generally rectangular openings 122 within each of which is inserted a retangularly shaped key 140, the inner end of which projects radially inwardly beyond the bore of the key mounting sleeve 120, and the outer end is retained by retainer sleeve 130. If more than one key 140 is utilized, they are preferbly equally spaced around the periphery of mounting sleeve 120. Preferably, two keys are employed.

On the top end surface 124 of the key mounting sleeve 120, a key supporting ring 150 is mounted for free rotation relative to the outer sleeve 110. Key supporting ring 150 is provided with one or more keys 160 having threaded outer ends 161 engaged in the ring 150, and radially inwardly projecting cylindrical ends 162. Thus the keys 160 are rigidly secured to the key supporting ring 150 and are freely rotatable relative to the outer sleeve 110. If more than one rotating key 160 is provided, they are distributed in equally spaced relationship around the periphery of the sleeve assembly 100. In the particular example illustrated in the drawings, two such keys 160 are provided at 180° peripheral spacing relative to each other.

The other sleeve assembly 200 is provided with a bottom sub 201 which has suitable threads (not shown) for incorporation in either the tubing string T3 or T4. An inner sleeve 210 has its bottom end threadably engaged with threads 202 provided in the bottom sub 201 and extends upwardly therefrom in telescoping sliding relationship to the outer sleeve 110, the outer surface 211 of inner sleeve 210 sliding in the bore 121 of the outer sleeve 110. A suitable O-ring seal 205 prevents fluid leakage between the bottom sub 201 and the internal sleeve 210.

At the upper end of inner sleeve 210, a sliding seal assembly 220 is conventially mounted and prevents fluid leakage between sliding surfaces 121 and 211.

The internal sleeve 210 is provided with a number of axially extending slots 212, equal to the number of rectangular keys 140, which respectively receive the rectangular ends of keys 140 therein to permit free sliding movement of inner sleeve 210 relative to outer sleeve 110 within the limits of the elongated axial slots 212. Rectangular keys 140 thus also transmit torque between sleeve assemblies 100 and 200. The full extent of the axial slots 212 is shown in the developed views of FIGS. 4A, 4B and 4C.

Figure 4A:
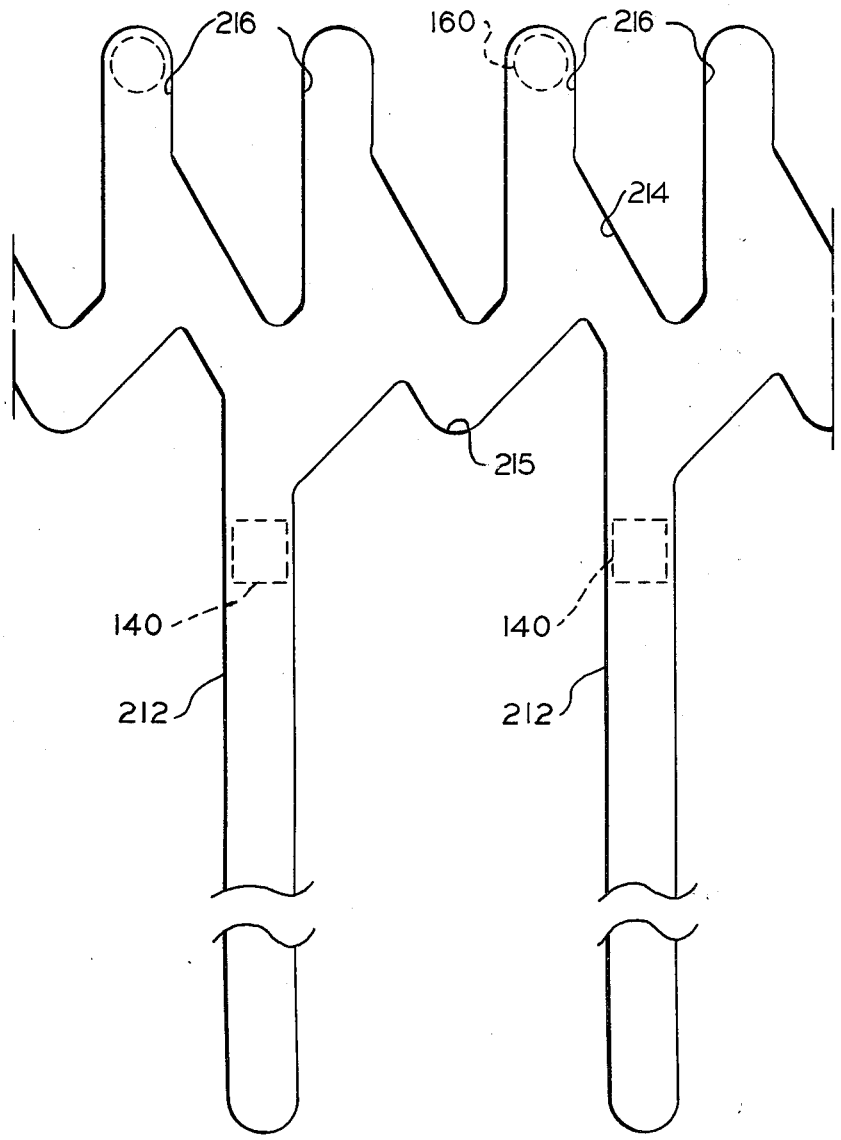
FIG. 4A is an expanded developed view of the key slots provided in one of the sleeve assemblies of the telescoping joint of FIGS. 3A–3C, illustrating the position of the cooperating keys when the telescoping joint is in its maximum expansion position.
Figure 4B:
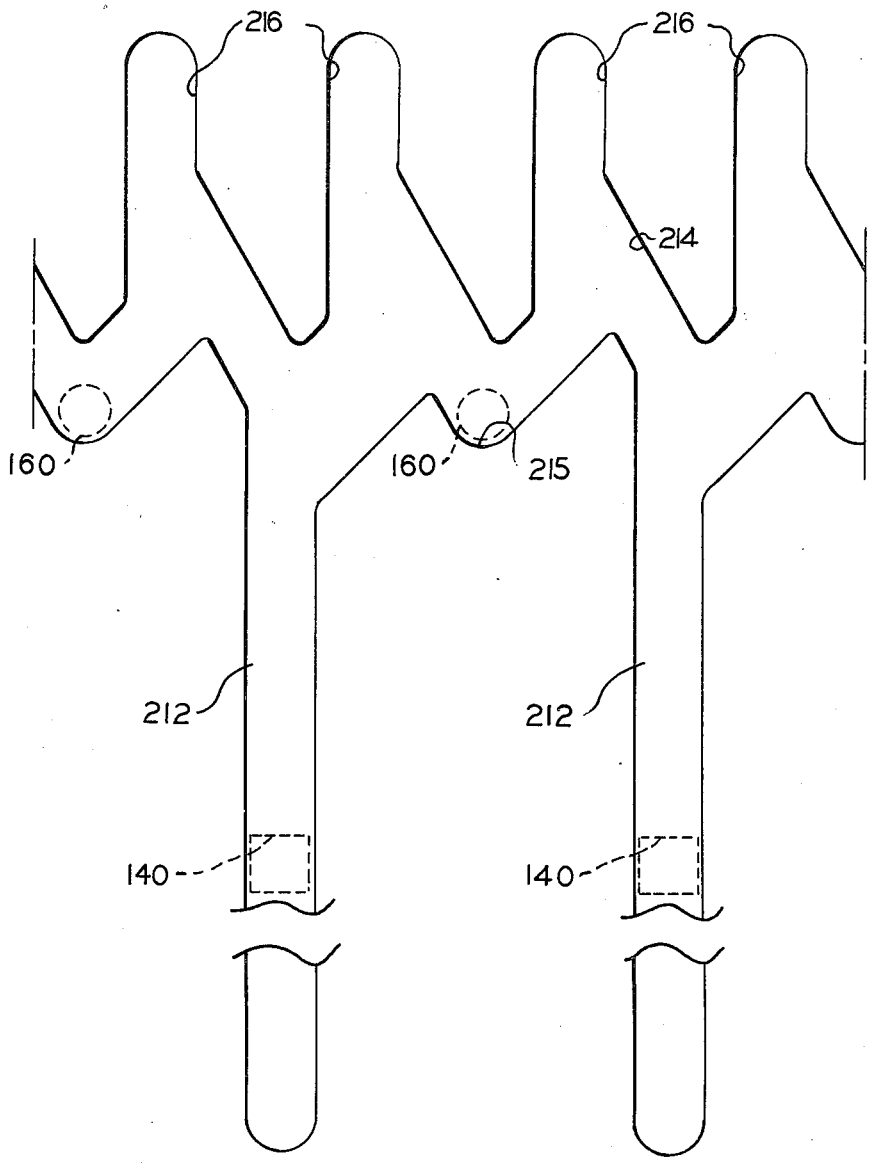
FIG. 4B is a view similar to FIG. 4A but showing the position of the cooperating keys when the telescoping joint is in its position of limited axial contraction in order to effect a "spudding" operation.
Figure 4C:
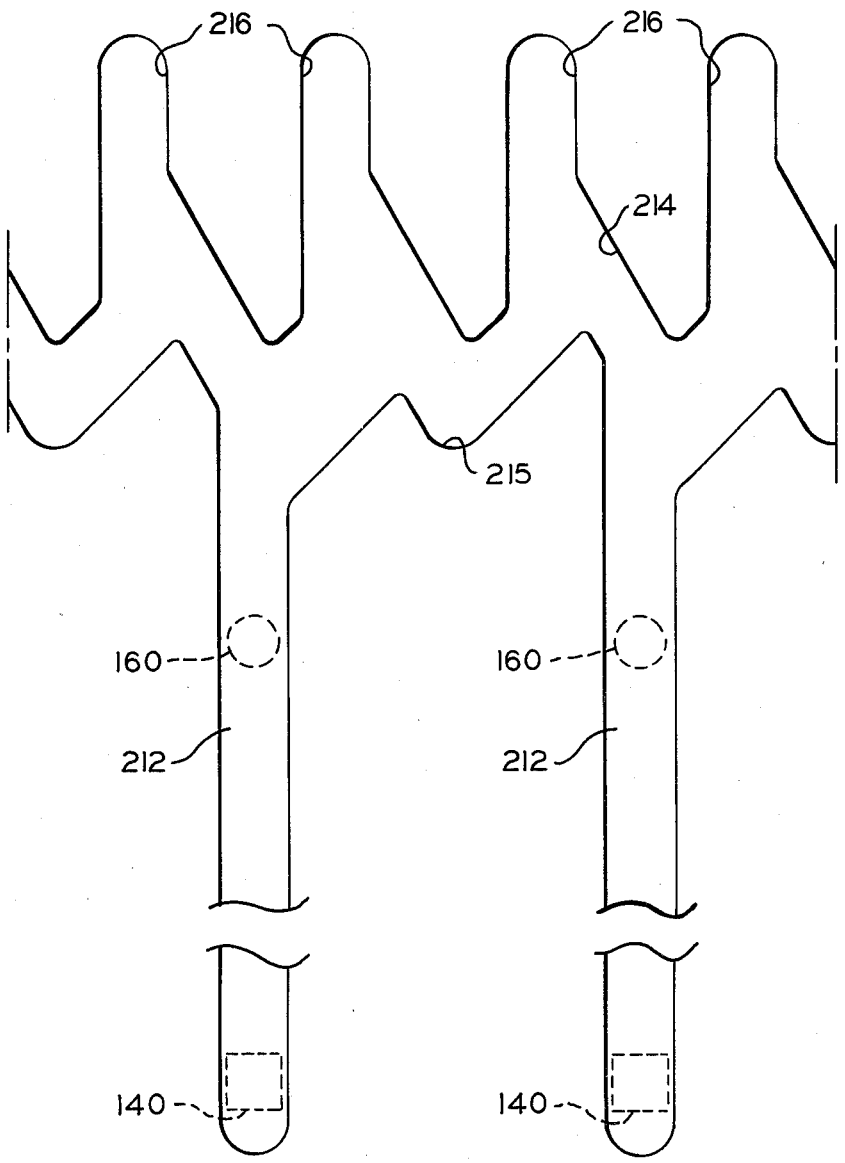
FIG. 4C is a view similar to FIG. 4A, but illustrating the position of the cooperating keys with the slots when the telescoping joint is in its fully contracted position.

Additionally, the top portion of the inner sleeve 210 is provided with a peripherally extending slot 214 which is specifically illustrated in FIGS. 4A–4C and can be best described as being of zig-zag configuration with alternate troughs of the zig-zag configuration communicating with the axially extending slots 212. More specifically, peripheral slot 214 comprises a series of connected V-shapes having limited axial extensions 216 at their upper ends, and trough portions 215.

OPERATION

From the foregoing description, it will be apparent that when the inner and outer sleeve assemblages 100 and 200 are reciprocated relative to each other, the cylindrical ends 162 of the rotatable keys 160 will be successively engaged by the inclined walls of the peripherally extending zig-zag slot 214 to effectively intermittently rotate the cylindrical keys 160 and their supporting ring 150 relative to the outer sleeve assemblage 100. Thus, as illustrated in FIG. 4A, when the telescoping joint TJ is in its position of maximum extension, the positions of the rectangular keys 140 and the round keys 160 relative to the axial slots 212 and peripherally extending slots 214 will be as shown in FIG. 4A. The next contracting movement of the sleeve assembly 100 relative to the sleeve assembly 200 will effect the downward movement of both the square keys 140 and the round keys 160, but the round keys 160 will enter the troughs 215 of the peripherally extending slots 214 which are disposed intermediate the two axially extending slots 212, as shown in FIG. 4B. Thus, in this position, the extent of contraction movement of the sleeve assembly 100 relative to the sleeve assembly 200 is effectively limited to the axial length of the peripherally extending zig-zag slot 214. Hence, in this position, the spudding operation can be accomplished with the tubing strings T3 or T4, as the case may be. The next reciprocation of the sleeve assembly 100 relative to the sleeve assembly 200 will, however, bring the round keys 160 into alignment with the axially extending slots 212, permitting the round keys 160 to enter such slots and permitting the maximum contraction of the telescoping joint TJ to occur, as schematically illustrated in FIG. 4C.

The space-out tubing section and tubing hanger assembly incorporating this invention may be applied to one or more tubing strings, preferably extending from a surface hanger. The specific showing of two space-out tubing strings T3 and T4 is merely for purposes of illustration. A single space-out tubing string could be employed in wells employing only a single production tubing string below the sub-surface hanger H. When, however, two or more space-out tubing strings are employed, it is important that the telescoping joints TJ utilized in each space-out tubing string be initially assembled with the round keys 160 respectively in the same relative angular positions in the peripherally extending slots 214 in each of the telescoping joints TJ employed in the various space-out tubing string in order to insure that each tubing string will, at the same time, be permitted to contract to its maximum extent or be limited to the minimum contraction required to effect the spudding operation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A torque transmitting telescoping joint for incorporation on a conduit carrying downhole well components, comprising: a first sleeve assembly having means on one end thereof for connection to the conduit; a second sleeve assembly having one end telescopingly, slidably insertable in the other end of said first sleeve assembly; means on the other end of said second sleeve assembly for connection to the conduit; a radially projecting first key fixedly mounted on one of said sleeve assemblies; an axially extending slot of predetermined length formed in the other of said sleeve assemblies and slidably receiving said first key, thereby transmitting torque between said sleeve assemblies in all relative axial positions permitted by the length of said axial slot; a key support means rotatably mounted on said one sleeve assembly in a fixed axial position, a second radially projecting key secured to said key support means; and a peripherally extending slot in said other sleeve assembly of a configuration having an effective axial length substantially less than the length of said axially extending slot, said peripherally extending slot receiving the end of said second key, whereby successive axial contraction and expansion movements of said sleeve assemblies relative to each other produce a unidirectional rotation of said key support means and said second key relative to said sleeve assemblies, said axially extending slot communicating with a trough portion of said peripherally extending slot, whereby said second key limits the relative axial movements of said sleeve assemblies to the axial extent of said peripherally extending slot until said second key is rotated into alignment with said axially extending slot.

2. The telescoping joint of claim 1 wherein a plurality of first keys are provided in peripherally spaced array on said one sleeve assembly, and said second sleeve assembly defines a plurality of axially extending slots respectively receiving said plurality of first keys and connecting with trough portions of said slot, said peripherally extending slot having at least one trough portion disposed intermediate each trough portion connected with an axial slot.

3. A torque transmitting telescoping joint for incorporation on a conduit carrying downhole well components, comprising: a first sleeve assembly having means on one end thereof for connection on the conduit; a second sleeve assembly having one end telescopingly, slidably insertable in the other end of said first sleeve assembly and means on the other end of said second sleeve assembly for connection on the conduit; an inwardly projecting first key fixedly mounted in said first sleeve assembly; an axially extending slot of predetermined length formed in said second sleeve assembly and slidably receiving said first key, thereby transmitting torque between said sleeve assemblies in all relative axial positions permitted by the length of said axial slot; a key support means rotatably mounted on said first sleeve assembly in a fixed axial position; a second inwardly projecting key secured to said key support means; and a peripherally extending slot in said second sleeve assembly having limited length axial portions connected by V-shaped trough portions, whereby successive axial contraction and expansion movements of said sleeve assemblies produce a unidirectional rotation of said key support means and said second key relative to said sleeve assemblies the axial extent of said peripherally extending slot being substantially less than the length of said axially extending slot, said axially extending slot communicating with one of said trough portions of said peripherally extending slot, whereby said second key limits the relative axial movements of said sleeve assemblies to the axial extent of said peripherally extending slot until said second key is rotated into alignment with said axially extending slot.

4. The telescoping joint of claim 3 wherein a plurality of first keys are provided in peripherally spaced array on said first sleeve assembly and said second sleeve assembly defines a plurality of axially extending slots respectively receiving said plurality of first keys, said peripherally extending slot having at least one trough portion intermediate each trough portion connecting with an axial slot.

5. The telescoping joint of claim 1 or 3 wherein said first key is of rectangular cross section to facilitate torque transmission thereby, and said second key is of circular cross section to permit said key to be moved freely along said peripherally extending slot by successive relative contraction and expansion movements of said sleeve assemblies.

6. An apparatus for producing a well from productive zones penetrated by the well bore in which casing is set below the top of the well, said apparatus comprising: a downhole tubing hanger means secured to an upper level of the casing and supporting at least one lower production tubing string communicating with a production zone; a surface tubing hanger arranged to seat in a hanger bowl in the top portion of the casing; at least one space-out tubing string extending from said downhole hanger to said surface hanger and removably sealingly connectable in said downhole hanger to said lower production string to transmit production fluid from said lower production tubing string to the surface, each said space-out tubing string including a safety valve and a torque transmitting telescoping joint, said joint including means operable by successive reciprocations of said space-out tubing string for selectively limiting the axial contraction movement of said telescopic joint to facilitate seating of said space-out tubing string in said downhole tubing hanger.

7. The apparatus of claim 6 wherein said torque transmitting, telescoping joint comprises: a first sleeve assembly having means on one end thereof for connection in the space-out tubing string; a second sleeve assembly having one end telescopingly, slidably insertable in the other end of said first sleeve assembly; means on the other end of said second sleeve assembly for connection in the space-out tubing string; a radially projecting first key fixedly mounted on one of said sleeve assemblies; an axially extending slot of predetermined length formed in the other of said sleeve assemblies and slidably receiving said first key, thereby transmitting torque between said sleeve assemblies in all relative axial positions permitted by the length of said axial slot; a key support means rotatably mounted on said one sleeve assembly in a fixed axial position, a second radially projecting key secured to said key support means; and a peripherally extending slot in said second sleeve assembly having an effective axial length substantially less than the length of said axially extending slot, said peripherally extending slot receiving the projecting end of said second key, whereby successive axial contraction and expansion movements of said sleeve assemblies relative to each other produce an unidirectional rotation of said key support means and said second key relative to said sleeve assemblies, said axially extending slot communicating with a trough portion of said peripherally extending slot, whereby said second key limits the relative axial movements of said sleeve assemblies to the axial extent of said peripherally extending slot until said second key is rotated into alignment with said axially extending slot.

8. The apparatus of claim 7 wherein a plurality of first keys are provided in peripherally spaced array on said first sleeve assembly and said second sleeve assembly defines a plurality of axially extending slots respectively receiving said plurality of first keys and communicating with trough portions of said peripherally extending slot, said peripherally extending slot having at least one trough portion intermediate each trough portion connecting with an axial slot.

9. An apparatus for producing productive zones penetrated by a well bore in which casing is set below the top of the well, said apparatus comprising: a downhole tubing hanger means secured to an upper level of the casing and supporting a plurality of production tubing strings respectively communicating with production zones of the well; a surface tubing hanger arranged to seat in a tubing bowl in the top portion of the casing; a plurality of space-out tubing strings extending from said downhole hanger to said surface hanger and respectively sealingly connectable in said downhole hanger to said lower production strings to transmit production fluid from the respective lower production tubing string to the surface, each said space-out tubing string including a safety valve and a torque transmitting telescoping joint, said joint including means operable by successive reciprocations of said space-out tubing string for selectively limiting the axial contraction movement of said telescoping joint to faciliate simultaneous seating of each said space-out tubing string in said downhole tubing hanger.

10. The apparatus of claim 9 wherein said torque transmitting, telescoping joint comprises: a first sleeve assembly having means on one end thereof for connection in the space-out tubing string; a second sleeve assembly having one end telescopingly, slidably insertable in the other end of said first sleeve assembly; means on the other end of said second sleeve assembly for connection in the space-out tubing string, a radially projecting first key fixedly mounted on one of said sleeve assembly; an axially extending slot of predetermined length formed in the other of said sleeve assemblies and slidably receiving said first key, thereby transmitting torque between said sleeve assemblies in all relative axial positions permitted by the length of said axial slot; a key support means rotatably mounted on said one sleeve assembly in a fixed axial position; a second radially projecting key secured to said key support means; and a peripherally extending slot in said second sleeve assembly having an effective axial length substantially less than the length of said axially extending slot, said peripherally extending slot receiving the projecting end of said second key, whereby successive axial contraction and expansion movements of said sleeve assemblies relative to each other produce an unidirectional rotation of said key support means and said second key relative to said sleeve assemblies, said axially extending slot communicating with a trough portion of said peripherally extending slot, whereby said second key limits the relative axial movements of said sleeve assemblies to the axial extent of said peripherally extending slot until said second key is rotated into alignment with said axially extending slot.

11. The apparatus of claim 10 wherein a plurality of first keys are provided in peripherally spaced array on said first sleeve assembly and said second sleeve assembly defines a plurality of axially extending slots respectively receiving said plurality of first keys and connected to trough portions of the peripherally extending slot, said peripherally extending slot having at least one trough portion intermediate each trough portion connecting with an axial slot.

12. The apparatus of claim 7 or 10 wherein the slot engaging portion of each first key is of rectangular configuration, and the slot engaging portion of each second key is of circular configuration.

13. The apparatus of claim 1, 3, 7 or 10 wherein the peripherally extending slot is of a generally zig-zag configuration.

* * * * *